US005266972A

United States Patent [19]

Gotho et al.

[11] Patent Number: 5,266,972

[45] Date of Patent: Nov. 30, 1993

[54] THERMAL PRINTER FOR RECORDING PAPER IN THE FORM OF A ROLL

[75] Inventors: Toshihiko Gotho, Tokyo; Kohtarou Tanno, Kanagawa; Akira Shimizu, Ibaragi, all of Japan

[73] Assignees: Hitachi, Ltd., Kanagawa; Hitachi Video Engineering, Inc., Tokyo, both of Japan

[21] Appl. No.: 493,247

[22] Filed: Mar. 14, 1990

[30] Foreign Application Priority Data

Mar. 14, 1989 [JP] Japan ..... 1-059667

[51] Int. Cl.[5] ..... B41J 2/325

[52] U.S. Cl. ..... 346/76 PH; 400/248

[58] Field of Search ..... 346/76 PH, 136; 400/234, 248, 120 MC, 120 MP

[56] References Cited

U.S. PATENT DOCUMENTS

| | | | |
|---|---|---|---|
| 4,614,950 | 9/1986 | Ito | 346/76 PH |
| 4,661,824 | 4/1987 | Kuge | 346/76 PH |
| 4,661,826 | 4/1987 | Saitou | 346/76 PH |
| 4,862,193 | 8/1989 | Hattori et al. | 346/76 PH |
| 4,972,207 | 11/1990 | Ishiyama et al. | 346/76 H |

FOREIGN PATENT DOCUMENTS

| | | | |
|---|---|---|---|
| 0001274 | 1/1984 | Japan | 400/120 |
| 0092871 | 4/1987 | Japan | 346/76 PH |
| 0059568 | 3/1988 | Japan | 400/234 |
| 1115668 | 5/1989 | Japan | 346/76 PH |

*Primary Examiner*—Benjamin R. Fuller
*Assistant Examiner*—N. Le
*Attorney, Agent, or Firm*—Antonelli, Terry Stout & Kraus

[57] ABSTRACT

A thermal transfer recording device including a thermal line head having heat generating elements thereon, a record paper in form of a roll of paper, a platen roller disposed in opposition to the thermal band, an ink jet sheet interposed between the platen roller and the thermal head and extending on opposite sides with respect to the platen roller, and at least a first record paper transport device disposed upstream in the transporting direction of the record paper with respect to the platen roller for at least feeding the record paper from the roll of paper toward the platen roller. At least a first wrapping member disposed on the first record paper transport device side with respect to the platen roller and arranged for pressing the ink sheet toward the platen roller when the thermal head is in a non-printing position floating above the platen roller so that a leading edge of the record paper transported by the first record transport device is guided by the ink sheet and by the wrapping member along the platen roller with sufficient tension to enable the leading edge of the record paper be fed without wrinkling of the record paper through the path therefor extending from the first record transport device.

15 Claims, 4 Drawing Sheets

THERMAL PRINTER FOR RECORDING PAPER IN THE FORM OF A ROLL

BACKGROUND OF THE INVENTION

The present invention relates to a thermal transfer recording device, and more particularly to a thermal transfer recording device which carries out color printing on record paper using a multi-color ink sheet in the form of a roll.

A thermal transfer recording device has been developed wherein, using an ink sheet in the form of a roll to which inks of different colors are applied successively at different portions of a face thereof, the inks of the different colors are transferred successively in an overlapping relationship to the same location on record paper by means of a heat sensitive line head to obtain a color print. A thermal transfer recording device of the type mentioned wherein a capstan of a rigid body is driven forwardly/backwardly to feed/return record paper in order to prevent displacement in print position between different color inks or bending of the record paper upon printing is disclosed in Japanese Patent Application Laid-Open No. 60-38181. According to this prior art, color displacement of a print is prevented and the record paper is fed back without being bent and, accordingly, a color print of a high quality can be obtained.

In the prior art described above, it is necessary to always keep record paper in tension by a capstan and a pinch roller which are located on the opposite side of a supply source of the record paper with respect to a platen roller. Consequently, a print disabled portion normally of 30 mm to 40 mm or so is produced at an end of the record paper between the platen roller and the capstan, and after printing is completed and the record paper is discharged, the print disabled portion must be cut and removed.

SUMMARY OF THE INVENTION

It is an object of the present invention to provide a thermal transfer recording device which can achieve color printing having no color displacement over the entire face of the record paper without producing a print disabled marginal portion on the record paper which is fed from a roll of the record paper.

The object of the present invention is achieved by a thermal transfer recording device which includes a supply source of record paper in the form of a roll, pinch roller, a platen roller, and a cutter, wherein a first record paper transport arrangement is provided on the side of the supply source of the record paper with respect to the platen roller while a second record paper transport arrangement is provided on the opposite side to the supply source of the record paper with respect to the platen roller, and a wrapping roller is provided in the neighborhood of the platen roller such that, when the heat sensitive line head prints and when the heat sensitive line head is moved by a small distance in a direction away from the platen roller, the wrapping roller causes the record paper and an ink sheet to closely contact each other and be wrapped over a predetermined angular range around the platen roller.

In accordance with the present invention, prior to printing, the record paper is fed out to the downstream side (cutter side) by a predetermined amount farther than the platen roller by the pinch roller. After the head is contacted under pressure, the record paper is recorded toward the end thereof while being drawn in by the pinch roller. Consequently, printing to the extreme end of the record paper is enabled.

According to a feature of the present invention, the record paper from the roll is fed out into a gap between the platen roller and the ink sheet to which a predetermined tension is applied by the pinch roller, along the direction of a tangential line to the ink sheet and the platen roller. When the record paper is wrapped over an angle of 20 degrees to 30 degrees around an outer periphery of the platen roller, it is closely contacted with the platen roller mainly by the frictional force thereof with the platen roller, but since the platen roller is driven by way of a clutch, the circumferential speed of rotation of the platen roller becomes equal to the circumferential speed of the pinch roller. Consequently, an accurate amount of transport and positioning of the record paper by the pinch roller are assured without causing a wrinkle or slack upon drawing in or drawing out of the record paper involved in printing.

After completion of printing with one color, the ink sheet and the record paper are frequently in a closely contacting condition, and therefore, the record paper is drawn out until the transport route of the ink sheet and the transport route of the record paper are separated perfectly from each other. Upon multi-color printing, the operation described above is repeated again after the record paper has been fed out by a predetermined amount to the downstream side. In order to feed out the record paper between the ink sheet and the platen roller, the heat sensitive line head is spaced by a small distance away from the platen roller and a predetermined tension is applied to the ink sheet to form a transport route for the record paper between the ink sheet and the platen roller. The platen roller is driven by way of the clutch at a speed higher than the feeding out speed of the record paper by the pinch roller to feed out an end of the record paper without causing slack, displacement or a wrinkle.

Further, after the record paper is wrapped around the platen roller, the second record paper transport arrangement for feeding out an end of record paper toward the cutter is driven by way of a clutch at a speed higher than the record paper transport speed by the platen roller. Consequently, the record paper can be mounted without causing slack or a wrinkle, and after completion of printing, the cutting position of the record paper by the cutter can be set to a predetermined position.

The above and other objects, features and advantages of the present invention will become more apparent from the following description when taken in connection with the accompanying drawings which show, for the purposes of illustration only, several embodiments in accordance with the present invention.

DESCRIPTION OF THE PREFERRED EMBODIMENTS

Figure 1:
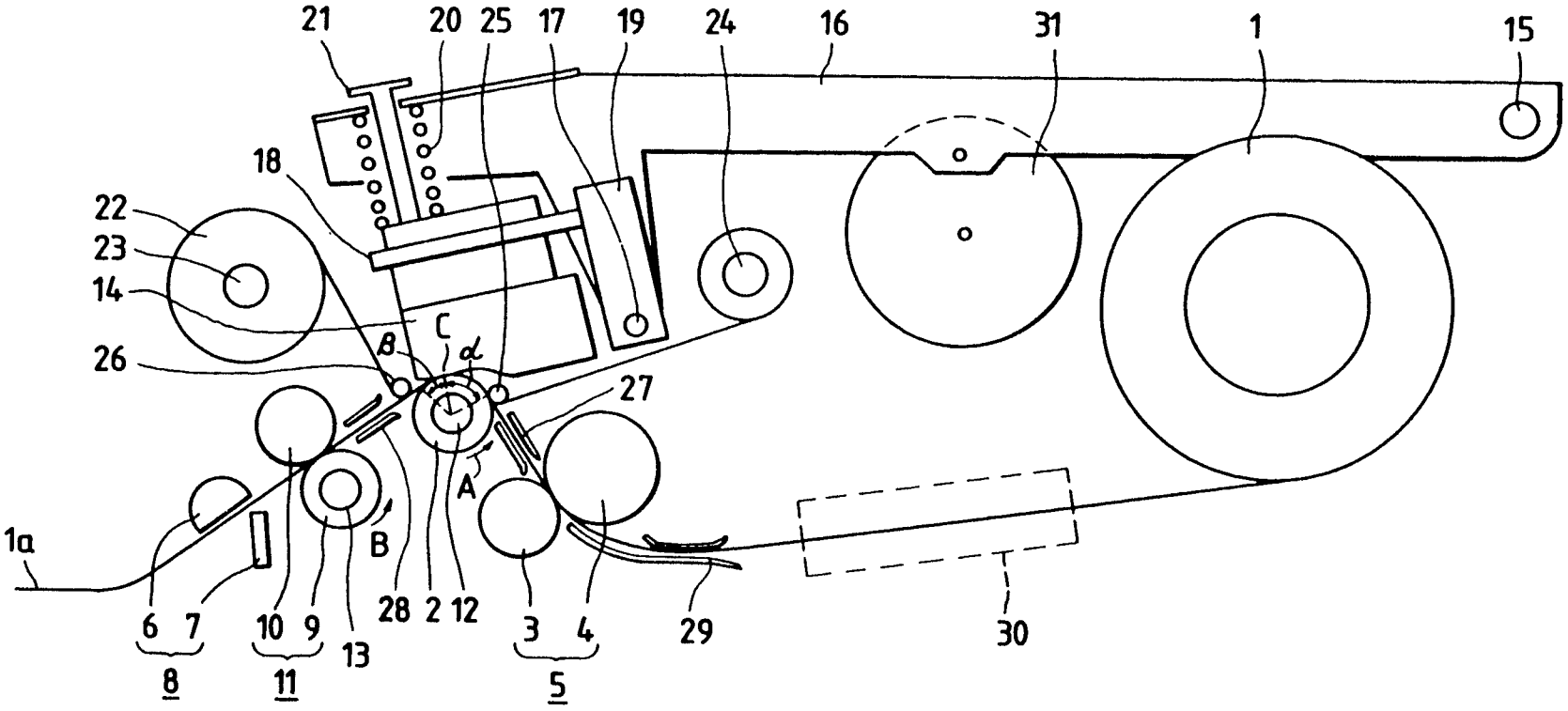
FIG. 1 is a constructional view of a first embodiment of a thermal transfer recording device according to the present invention.

Referring now to the drawings wherein the like reference numerals are utilized to designate like parts throughout the several views.

FIG. 1 illustrates a constructional view of a first embodiment of a thermal transfer recording device according to the present invention wherein reference numeral 1 denotes record paper in the form of a roll, 2 a platen roller having a surface covered with an elastic high friction material such as rubber, 5 a first record paper transport arrangement composed of a roller 3 of a rigid body and a pinch roller 4 of an elastic body, a cutter 8 having a movable blade 6 and a fixed blade 7, 11 a second record paper transport arrangement composed of a drawing out roller (driving roller) 9 of a high friction material and a driven roller 10, 12 a first clutch, 13 a second clutch, 14 a heat sensitive line head, 15 a support shaft, 16 a head arm, 17 a positioning shaft, 18 a rocking shaft, 19 a support member, 20 a compression spring, 21 a control pin, 22 an ink sheet in the form of a roll, 23 a supply shaft, 24 a take-up shaft, 25 a first wrapping roller, 26 a second wrapping roller, 27 a first record guide, 28 a second record guide, 29 a record introducing guide, 30 a record paper feeding device, and 31 a rocking device.

In FIG. 1 the platen roller 2 which is driven to rotate at least in the direction of an arrow A by a driving source (not shown) by way of the first clutch 12 is disposed at a location opposing heat generating elements C of the heat sensitive line head 14. A transfer passage is formed between the platen roller 2 and the heat sensitive line head 14 and the record paper 1 is arranged such that it may be sent out from or rewound to the supply source so as to move in such a manner that it may move along the transfer passage and be contacted with the platen roller 2.

Meanwhile, the ink sheet 22 is wrapped between the supply shaft 23 and the take-up shaft 24 located on the opposite sides of the heat sensitive line head 14 so as to move along the transfer passage in such a manner that it may be contacted with the record paper 1 at part of a circumferential face of the platen roller 2.

Figure 2:
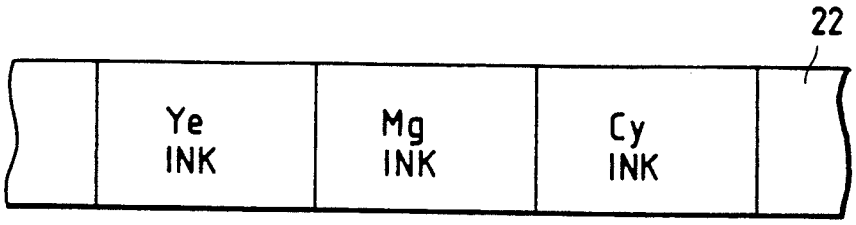
FIG. 2 is a front elevational view of an ink sheet shown in FIG. 1.

FIG. 2 is a front elevational view of the ink sheet shown in FIG. 1, and the ink sheet 22 has sublimable or thermally transferable inks of three colors, of yellow (Ye), magenta (Mg) and cyan (Cy) applied successively to different faces of a film thereof.

Now, referring to FIG. 1, the supply shaft 23 and the take-up shaft 24 are drivable in opposite directions of forwarding/rewinding by a driving source (not shown) by way of a clutch (not shown).

The first record paper transport arrangement 5 is provided on the side of the supply source of the record paper 1 with respect to the platen roller 2, and the record, paper 1 can be held between the rigid body roller 3 and the pinch roller 4 of an elastic body of the first record paper transport arrangement. Fine concave and convex portions are formed on a surface of the roller 3 by flame coating processing or the like. The roller 3 is drivable to rotate in opposite directions by a DC motor or a stepping motor (not shown), and the rotational angle thereof can be monitored.

The record paper feeding device 30 is provided between the first record paper transport arrangement 5 and the supply source of the record paper 1. The record paper feeding device 30 is composed of a roller or the like and provides a drive such that it may send out the record paper 1 from the supply source into the transfer passage or rewind the record paper 1 as occasion calls or operates as a mere record paper guide by a disengaging movement of the clutch or the roller. The feeding speed of the record paper feeding device 30 is set equal to the feeding speed of the record paper 1 at the roller 3 by the first record paper transport arrangement 5.

The second record paper transport arrangement 11 is provided on the side opposite to the supply source of the record paper 1 with respect to the platen roller 2 and the record paper 1 can be held between the drawing out roller (driving roller) 9 of a high friction material and the driven roll 10 of the second record paper transport arrangement. The drawing out roller 9 is driven to rotate at least in the direction of an arrow B in FIG. 1 by a driving source (not shown) by way of the second clutch 13.

Further, the cutter 8 composed of the movable blade 6 and the fixed blade 7 is provided on the opposite side of the second transport paper transport arrangement 11 to the platen roller 2 and is disposed such that the movable blade 6 and the fixed blade 7 may be opposed to each other with the record paper 1 interposed therebetween.

The first wrapping roller 25 is mounted on the heat sensitive line head 14 by an arm member (not shown) in the neighborhood of the platen roller 2 on the side of the first record paper transport arrangement 5 with respect to the heat generating elements C of the heat sensitive line head 14 such that, when the heat sensitive line head 14 is moved a small distance in a direction away from the platen roller 2, the first wrapping 25 is spaced a small distance away from the platen roller 2.

The platen roller 2, first wrapping roller 25, roller 3 and pinch roller 4 are disposed such that they may have a common first contact plane, and the first record guide 27 is provided between the first record paper transport arrangement 5 and the first wrapping roller 25 in such a manner as to hold the first contact plane therebetween. The ink sheet 22 is wrapped over a range of about 30 degrees to 80 degrees by central angle $\alpha$ from the position of the heat generating elements C on an outer periphery of the platen roller 2 by the first wrapping roller 25. A record paper introducing guide is provided between the first record paper transport arrangement 5 and the record paper feeding means 30 such that the first contact plane may be contacted with the roll which is the supply source of the record paper 1.

The central angle $\beta$ provided by a contact point with the platen roller 2 of a second contact plane which is held between the drawing out roller 9 and the driven roller 10 and is contacted with the platen roller 2 and another contact point of the heat generating elements C with the platen roller 2 is set substantially to 5 degrees to 10 degrees.

Meanwhile, the second wrapping roller 26 provided on the heat sensitive line head 14 by an arm member (not shown) is disposed such that it may be contacted with the second contact plane when the heat sensitive line head 14 is spaced a small distance away from the platen roller 2. In the present embodiment, the second record paper guide 28 is provided between the second record paper transport arrangement 11 and the second wrapping roller 26 in such a manner as to hold the second contact plane therebetween.

The record paper 1 is guided by the first record paper guide 27, introduced into the transfer passage from between the first wrapping roller 25 and the platen roller 2 while contacting the circumferential face of the platen roller 2, and introduced into the second record paper transport arrangement 11 from between the second wrapping roller 26 and the platen roller 2 under the guidance of the second record paper guide 28.

Meanwhile, the ink sheet 22 is introduced from the supply shaft 23, passage between the second wrapping roller 26 and the platen roller 2, into a transfer passage in such a manner as to contact the record paper 1 and is then led out to the take-up shaft 24 from between the first wrapping roller 25 and the platen roller 2.

Figure 3:
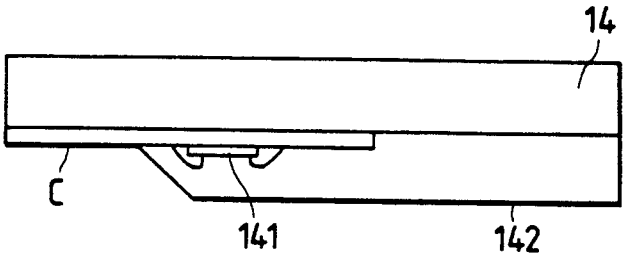
FIG. 3 is a side elevational view of a construction of a heat sensitive line head shown in FIG. 1.

FIG. 3 is a side elevational view illustrating construction of the heat sensitive line head shown in FIG. 1, and reference character C denotes a heat generating element, 14 a heat sensitive line head, 141 a driving IC array, and 142 a cover. The heat sensitive line head 14 has the driving IC array 141 provided to the side of the heat generating elements C, and the location is covered with the cover 142.

Aiming at a compact construction for realizing the wrapping angle (winding angle) of the ink sheet 22 around the platen roller 2 described above, an arrangement is employed wherein the side of the driving IC array 141 is set to a location at which the wrapping angle on the platen roller 2 is greater.

Figure 4:
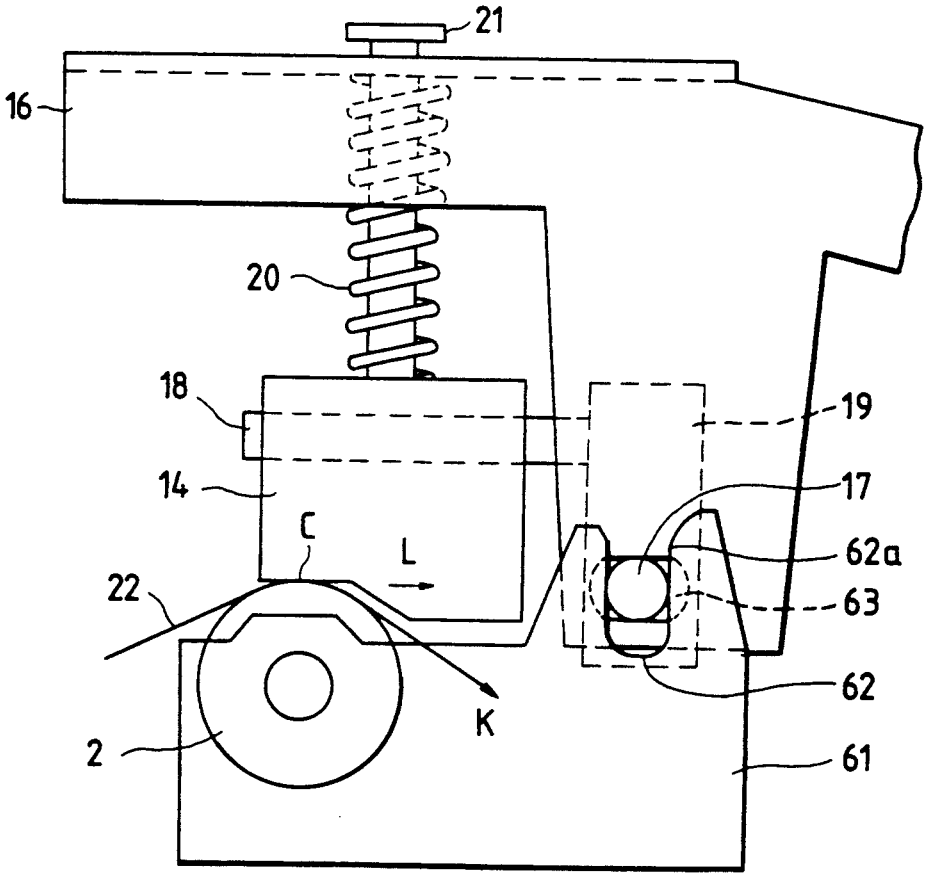
FIG. 4 is an explanatory view of a positioning structure for the heat sensitive line head shown in FIG. 1.

FIG. 4 is an explanatory view of a positioning structure for the heat sensitive line head shown in FIG. 1 wherein there is shown the platen roller 2, the heat sensitive line head 14, a head arm 16, a positioning shaft 17, a rocking shaft 18, a support member 19, a compression spring 20, a control pin 21, an ink sheet 22, a chassis 61 and a U-shaped groove 62. An elongated hole 63 is provided in the head arm 16.

Figure 5:
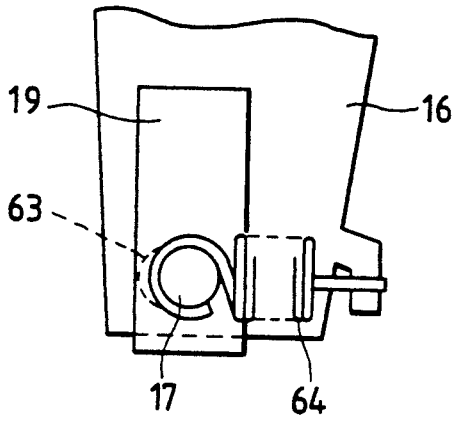
FIG. 5 is an explanatory view of a part of the positioning structure shown in FIG. 4.

FIG. 5 is an explanatory view of a part of the construction of FIG. 4, showing the a head arm 16, the positioning shaft 17, the support member 19, the elongated hole 63, and a spring 64.

Referring to FIGS. 1, 4 and 5, the heat sensitive head 14 is provided at an end of the head arm 16 having one end supported for rotation on the support shaft 15 and is mounted for movement into and out of line contact with the platen roller 2 by the rocking device 31 connected to the head arm 16. Here, the heat sensitive head 14 is assembled to the head arm 16 by the head supporting member 19 which has the positioning shaft 17 extending substantially in parallel to the platen roller 2 and perpendicularly to the planes of the figures and the rocking shaft 18 extending substantially perpendicularly to the platen roller 2, and in parallel to the planes of the figures, and the heat sensitive head 14 is pressed against the platen roller 2 by the compression spring 20. Rocking motion of the heat sensitive line head 14 around the positioning shaft 17 upon pressing against the platen roller 2 is controlled with respect to the head arm 16 by the control pin 21 having a widened end, and the heat sensitive line head 14 and the platen roller 2 are constituted such that the relationship thereof may assume three conditions including a spaced condition, a fine air gap condition (a condition wherein the two merely contact with each other or there is an air gap equal to the thickness of a sheet of record paper or so between them), and a pressure contacting condition in accordance with up and down movement of the head arm 16. Shown in FIG. 1 is the pressure contacting condition or the fine air gap condition.

As shown in FIGS. 4 and 5, U-shaped grooves 62 having a width slightly greater than the positioning shaft 17 are formed, at locations at which they are engaged with the opposite ends of the positioning shaft 17, at part of the chassis 61 on which the platen roller 2 is supported for rotation on the opposite sides thereof. The directions of the U-shaped grooves 62 are selected so as to allow a turning portion of the positioning shaft 17 around the center provided by the support shaft 15 shown in FIG. 1. Further, the elongated hole 63 which extends substantially perpendicularly to the direction described above and is slightly elongated in the direction of a tangential line between the heat sensitive line head 14 and the platen roller 2 is formed in the head arm 16 with a width slightly greater than the positioning shaft 17. The head supporting member 19 is movable with respect to the head arm 16 by the elongated hole 63 by way of the positioning shaft 17, and the position thereof is movable in the direction of the tangential line described above.

As shown in FIG. 5, the positioning shaft 17 is urged, in the elongated hole 63, and displaced to a wall face opposite to the platen roller 2 by the spring 64. Meanwhile, the distance between the heat generating elements C of the heat sensitive line head 14 and the positioning shaft 17 is set to a value equal to the distance between a bearing for the platen roller 2 on the chassis 61 and the U-shaped groove 62. Due to such a construction as described above, when the heat sensitive line head 14 is contacted under pressure with the platen roller 2 by the rocking device 31 in FIG. 1, the heat sensitive line head 14 is positioned properly with respect to the platen roller 2 under the guidance of the U-shaped groove 62.

Further, upon printing, the ink sheet 22 is drawn in the direction of an arrow K of FIG. 4 and the heat sensitive line head 14 receives a frictional force in the direction of an arrow L at a contact portion thereof with the platen roller 2. In this instance, there is no production of a play or the like because the positioning shaft 17 is contacted under pressure with the wall face 62*a* of the U-shaped groove 62 on the opposite side to the platen roller 2 on the tangential line passing the heat generating elements C by the spring 64 shown in FIG. 5, and occurrence of an unacceptable print involved therein is prevented.

The operation of the embodiment described above will now be set forth.

Referring to FIG. 1, an end 1*a* of the record paper 1 is fed out into the first record paper transport arrangement 5 by the record paper feeding device 30 under the guidance of the record paper introducing guide 29 prior to starting of printing. The roller 3 of the first record paper transport arrangement 5 feeds the end 1*a* of the record paper 1 at a predetermined speed to the platen roller 2 along the first contact plane. In this instance, the heat sensitive line head 14 is moved away from the platen roller 2 into a fine air gap condition, and the ink sheet 22 is positioned such that the ink applied face thereof for the first color is positioned on the side of the supply shaft 23 with respect to the heat generating elements C including a contact point with the head generating members C. The take-up shaft 24 is braked, and a predetermined tension is applied to the ink sheet 22 between the take-up shaft 24 and the supply shaft 23. Further, the platen roller 2 is being driven at a higher circumferential speed than the roller 3 in the direction of the arrow A of FIG. 1.

After the end 1*a* of the record paper 1 fed by the roller 3 of the first record paper transport arrangement 5 is fed in between the ink sheet 22 and the platen roller 2, the record paper 1 is acted upon by a force in the direction of the arrow mark A of FIG. 1 from the platen roller 2. Since the circumferential speed of the platen roller 2 is higher than the circumferential speed of the roller 3, the record paper 1 is fed without causing a wrinkle or slack. After the end 1*a* of the record paper 1 is wrapped by a certain angle around the platen roller 2 in accordance with a coefficient of friction between the platen roller 2 and the record paper 1 and a value of the tension of the ink sheet 22, the record paper 1 is put into a closely contacting condition with the platen roller 2. Here, the platen roller 2 and the driving source therefor start mutual slipping thereof, and the circumferential speed of the platen roller 2 becomes equal to the circumferential speed of the roller 3. Consequently, the record paper 1 is fed into the second record paper transport arrangement 11 without causing a wrinkle or slack. The feeding out operation of the record paper 1 is continued in this condition, and after the distance between the position opposing to the heat generating elements C and the fed out end 1*a* of the record paper 1 becomes equal to a predetermined length (for example, the dimension along the length of a sheet of paper of A4 size), the feeding out of the record paper 1 is stopped, and the heat sensitive line head 14 is put into a closely contacting condition with the platen roller 2 by the head moving means.

Subsequently, the direction of rotation roller 3 of the first record paper transport arrangement 5 is reversed, and while rewinding the record paper 1, the heat sensitive line head 14 is energized in accordance with the feeding speed of the record paper 1 which is determined by an output of an encoder of the driving source or driving pulses of a motor of the driving source so that recording of a print on the record paper 1 with the first color is carried out. Since the record paper 1 has no slack, the printing position is fixed and recording of a print with a high degree of accuracy is carried out.

After completion of recording of a print with the first color for the predetermined length of the record paper 1, for example, the dimension along the length of A4 size, the record paper 1 is fed out again, and after the distance between the position opposing to the heat generating elements C and the position of a boundary of the printed portion becomes equal to the predetermined length (for example, the dimension along the length of a paper sheet of A4 size), the feeding out of the record paper 1 is stopped.

If the ink sheet 22 is moved until a portion thereof for a second color is opposed to the heat generating elements C and the heat sensitive line head 14 is put into a pressure contacting condition with the platen roller 2 whereafter the operation described above is repeated, then recording of a print with the second color is carried out, and recording of a print with a third color is carried out in a similar manner to complete recording of a print on the record paper 1. In this manner, a color print of a high quality free from color displacement can be formed without a marginal portion on the record paper 1 which is fed along the transfer passage without slack or a bend.

The record paper 1 after completion of printing is fed properly to a cutting position of the cutter 8 composed of the movable blade 6 and the fixed blade 7 without slack or a wrinkle by driving the drawing roller 9 of the second record paper transport arrangement 11 at a higher speed than the transport device for the record paper 1 by the platen roller 2, for example, by way of a clutch, and the printed portion is cut off with a high degree of accuracy.

Figure 6:
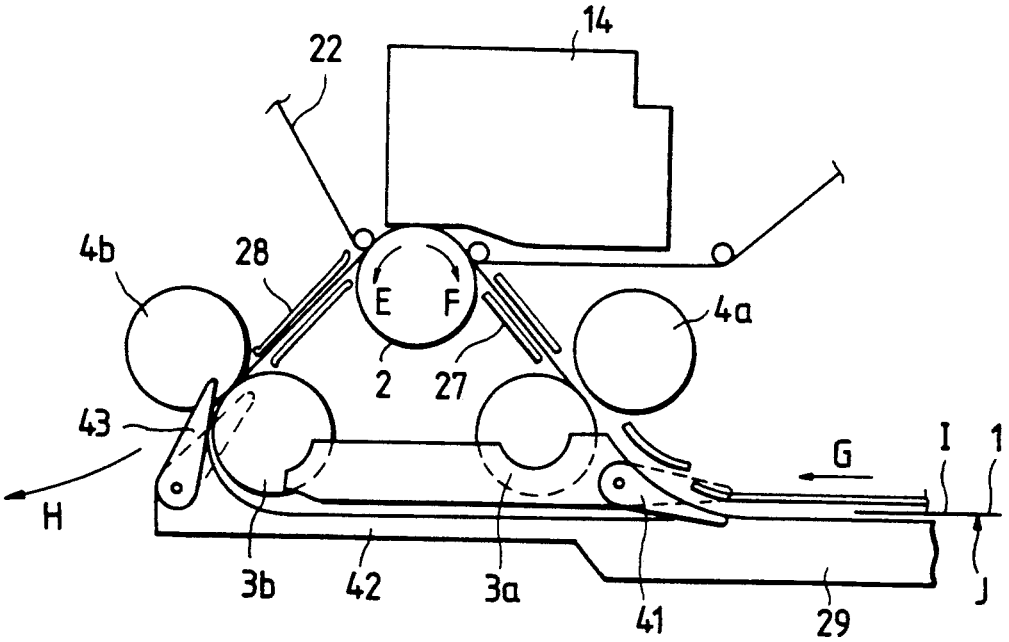
FIG. 6 is a constructional view of a record paper transport device illustrating a second embodiment of a thermal transfer recording device according to the present invention.

FIG. 6 is a constructional view of a record paper transport device illustrating a second embodiment of a thermal transfer recording device according to the present invention illustrating the record paper 1, the platen roller 2, feed rollers 3*a* and 3*b*, pinch rollers 4*a* and 4*b*, the heat sensitive line head 14, the ink sheet 22, the first record paper guide 27, the second record paper guide 28, a record paper introducing guide 29, a first transport passage changing over device 41, a bypass 42, and a second transport passage changing over device 43. In the second embodiment, the second feed roller 3*b* and the second pinch roller 4*b* are provided for a second record paper transport arrangement which corresponds in contraction to the record paper transport 5 arrangement in FIG. 1. The first transport passage changing over device 41, the bypass 42 and the second transport passage changing over device 43 are provided for introducing the record paper 1 from the cutter side of the second record paper transport arrangement 11.

The feed rollers 3*a* and 3*b* are individually drivable in opposite directions without having a torque limiter interposed therein, and where they are driven by way of torque limiters, they are constructed such that each can be rotated a little faster than the other. Though not shown, this can be attained by using an electromagnet clutch or by carrying out changing over of driving gear trains.

In the second embodiment, while the record paper 1 is fed out in the direction of an arrow G of FIG. 6 by setting the first transport passage changing over device 41 to its full line position in the figure and setting the second transport passage changing over device 43 to its broken line position of the figure, recording of a print is carried out on the entire face of an I face (front surface of the record paper 1) similarly as in the first embodiment. After completion of printing, an end of the record paper 1 is drawn back to a position forwardly of the first transport passage changing over device 41 by a bidirectional record paper feeding device (not shown). Subsequently, the first transport passage changing device 41 is changed over to its broken line position of the figure while the second transport passage changing over device 43 is changed over to its full line position of the figure, and then if the record paper 1 is fed in the direction of the arrow G by the bidirectional record paper feeding device, then the end 1*a* of the record paper 1 passes the bypass 42, comes around an outer periphery of the feed roller 3*b* and is introduced to a location between the feed roller 3*b* and the pinch roller 4*b*. Then, a process similar to that in the first embodiment is effected in such a manner that the directions of feed roller 3a and the feed roller 3b are reversed.

Consequently, recording of a print can be carried out on opposite faces (front and rear surfaces) of the record paper without having a marginal portion from the end. In this instance, the first transport passage changing over device 41 can prevent, when the reverse face of the record paper 1 is to be printed, the end of the record paper 1 from advancing toward the bidirectional record paper feeding device as shown in the figure.

The procedure described above may be reversed so that at first the J face (reverse face) and then the I face (front face) may be printed, and in this instance, the record paper 1 which comes out in the direction of an arrow H of FIG. 6 after printing of the opposite faces can be cut by the cutter 8 (not shown) immediately after it has been fed out by a predetermined amount.

It is to be noted that, upon printing of the J face→I face, it is necessary to reverse either one of reading out of two-dimensional original picture data and transfer of picture data to the heat sensitive head 14, but this can be realized by reversing, upon generation of a readout address of a picture image memory, either one of a column and a row by means of a counter or the like. The construction, operation and effects of the other portions of the second embodiment are the same as those of the first embodiment described above.

Figure 7:
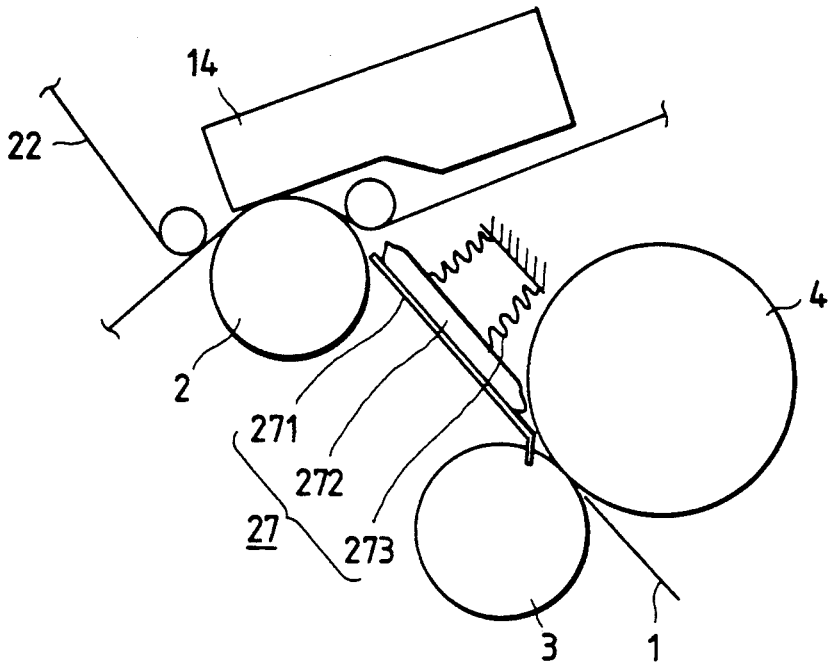
FIG. 7 is a constructional view of a first record paper guide illustrating a third embodiment of a thermal transfer recording device according to the present invention.

FIG. 7 is a constructional view of a first record paper guide illustrating a third embodiment of a thermal transfer recording device according to the present invention, wherein there is illustrated the record player, the platen roller 2, the feed roller 3, the pinch roller 4, the heat sensitive line head 14, the ink sheet 22, the first record paper guide 27, a fixed guide 271, a movable guide 272 and a spring 273. In FIG. 7, the first record paper guide 27 is composed of the fixed guide 271, the movable guide 272 and the spring 273 for urging the movable guide 272 toward the fixed guide 271 with such a degree of force under which the record paper 1 can move smoothly, and the movable guide 272 is prevented from being spaced away by a greater distance than a fixed distance while maintaining a position substantially parallel to the fixed guide 271 by means of a control link or the like (not shown).

With the construction described above, in the third embodiment, since occurrence of unnecessary slack or a wrinkle can be prevented until an end of the paper 1 enters between the platen roller 2 and the ink sheet 22, the feed roller 3 and the platen roller 2 can be driven at the same circumferential speed by a simple construction, and an expensive torque limiter mechanism can be omitted.

Although, not shown, in the third embodiment, it is possible to construct the other record paper guides such as the second record paper guide 28 in a similar manner, and similar effects can be exhibited while further simplifying the device. Construction, operation and effects of the other portion of the third embodiment are similar to those of the first embodiment described above.

Figure 8:
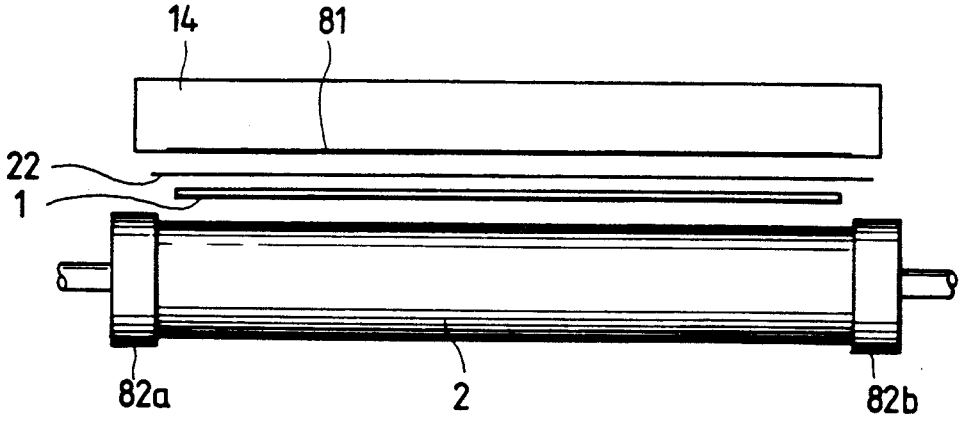
FIG. 8 is a constructional view of a platen roller portion illustrating a fourth embodiment of a thermal transfer recording device according to the present invention.

FIG. 8 is a constructional view of a platen roller portion illustrating a fourth embodiment of a thermal transfer recording device according to the present invention, wherein there is record paper 1, a platen roller 2, a heat sensitive line head 14, an ink sheet 22, a heat generating element array 81, and pillow portions 82a and 82b.

The fourth embodiment is constructed such that printing can be carried out fully in the widthwise direction of the record paper 1. In particular, as described already, according to the first embodiment, it is possible to print fully in the direction of the length of the record paper, but in order to print fully in the widthwise direction of the record paper, it is necessary to carry out printing with some margin left in the widthwise direction of the record paper. However, if printing is carried out with a margin left in the widthwise direction of the record paper, ink will disadvantageously stick directly to the platen roller 2 at a location outside the record paper.

Therefore, the heat generating element array 81 is mounted with a greater width than the width of the record paper 1 on the heat sensitive line head 14 as shown in FIG. 8, and the width of the ink sheet 22 is set further greater than the width of the heat generating element array 81. The pillow portions 82a and 82b having a radius greater by an amount (normally 20 to 80 μm or so) a little smaller than the thickness of the record paper 1 than the radius of the platen roller 2 are provided over the entire circumference at the opposite ends of the platen roller 2. The distance between the pillow portions 82a and 82b is set greater than the width of the record paper 1 but smaller than the width of the heat generating element array 81.

In the fourth embodiment, since it is constructed in such a manner as described above, it is possible to print fully in the widthwise direction of the record paper 1, and at portions of the record paper 1 on the opposite sides in the widthwise direction, the ink sheet 22 is heated by the heat generating element array 81, but since either there is a small air gap between the ink sheet 22 and the platen roller 2 or the pressing force against the platen roller 2 is extremely small, no transfer is made substantially to the platen roller 2. The construction, operation and effects of the other portions of the fourth embodiment described above are the same as those of the first embodiment described already. As described so far, according to the present invention, as an end of record paper is fed in to a position below a heat sensitive line head without causing slack or a wrinkle, printing can be carried out while rewinding the record paper with a high degree of accuracy by a roller, and color printing to the end of the record paper can be made without color displacement so that no blank portion is produced. Accordingly, a thermal transfer recording device can be provided which can attain printing of a high quality over an entire area of a region of a predetermined size of the record paper in a short printing period of time.

While we have shown and described several embodiments in accordance with the present invention, it is understood that the same is not limited thereto but is susceptible to numerous changes and modifications as known to one of ordinary skill in the art, and we therefore do not wish to be limited to the details shown and described herein but intend to cover all such modifications as are encompassed by the scope of the appended claims.

What is claimed is:

1. A thermal transfer recording device comprising:

a thermal line head including heat generating elements thereon;

record paper in a form of a roll of paper;

a platen roller disposed in opposition to the thermal head;

an ink sheet interposed between the platen roller and the thermal head and extending on opposite sides with respect to the platen roller;

first record paper transport means disposed upstream in a transporting direction of the record paper with respect to the platen roller for at least feeding the record paper from the roll of paper toward the platen roller;

wrapping means including at least a first wrapping member disposed on a first record paper transport means side with respect to the platen roller, the wrapping means being arranged for pressing the ink sheet toward the platen roller when the thermal head is in a non-printing position floating above the platen roller so that a leading edge of the record paper transported by the first record paper transport means is guided by the ink sheet and by a wrapping means along the platen roller with sufficient tension to enable the leading edge of the record paper to be fed without wrinkling of the record paper through a path therefor extending from the first record paper transport means; and means for moving the thermal head between the floating non-printing position thereof and a printing position in which the thermal head is pressed onto the platen roller with the ink sheet and record paper interposed therebetween for enabling recording without producing a print disabled marginal portion on the record paper.

2. A thermal transfer recording device according to claim 1, wherein the ink sheet and the first wrapping means enable feeding of the leading edge of the record paper so that the record paper and the ink sheet are wrapped around the platen roller over a predetermined first angular range of the platen roller delimited from a line of contact between the thermal head and the platen roller toward of the first record transport means.

3. A thermal transfer recording device according to claim 2, wherein the first predetermined angular range is a range of about 30 degrees to 80 degrees.

4. A thermal transfer recording device according to claim 2, wherein the wrapping means further includes a second wrapping member disposed on a downstream side of the platen roller with respect to a direction of feeding of the leading edge of the record paper, the first record paper transport means, wrapping means and ink sheet enabling automatic threading of the record paper from the roll of record paper about the platen roller.

5. A thermal transfer recording device according to claim 4, wherein wrapping angles of the ink sheet and the record paper around the platen roller upon printing are set substantially to an angular range of 30 degrees to 80 degrees at a portion before printing and an angular range of substantially 5 degrees to 15 degrees at another portion after printing with reference to a position in which the ink sheet and the record paper are pressed by the heat generating elements of the thermal head, and wherein the portion before printing is supported for rotation on the thermal head and the portion after printing contacted under pressure with the platen roller.

6. A thermal transfer recording device according to claim 2, wherein the predetermined first angular range is an acute angular range.

7. A thermal transfer recording device according to claim 1, wherein the ink sheet is in a form of a roll having different colors successively on different portions of a face thereof, and further comprising a second record paper transport means for transporting the and disposed downstream in the transporting direction of the record paper with respect to the platen roller, a record paper cutting means for cutting the record paper provided on a downstream side of the second guide paper transport means, a first record paper guide means for guiding the record paper provided between the platen roller and the first guide record paper transport means, and a second record paper guide means for guiding the record paper provided between the platen roller and the second record paper transport means.

8. A thermal transfer recording device according to claim 7, wherein the first record paper transport means includes a bi-directionally drivable rigid body driving roller and an elastic body driven roller for contacting the rigid body driving roller under pressure, the platen roller and the second record paper transport means each include a clutch receiving a driving force from a driving means therefor, the record paper being fed out from the roll of the record paper by a torque smaller than a fixed value by the clutch.

9. A thermal transfer recording device according to claim 8, further comprising a torque limiter provided between the second record paper transport means and means for driving the first record paper transport means, wherein the first record paper transport means is driven in a direction in which the record paper is fed out from the roll of the record paper, the platen roller and the second record paper transport means have driving speeds in a forward feeding direction of the record paper which are higher than a driving speed of the first record paper transport means.

10. A thermal transfer recording device according to claim 1, further comprising a head supporting member disposed for rocking motion coupled to the thermal head moving means by a positioning shaft extending substantially parallel to a shaft of the platen roller, the thermal head being supported on the head supporting member by a rocking shaft extending substantially perpendicularly to the positioning shaft and to a direction of movement of the thermal head into and out of contact with the platen roller.

11. A thermal transfer recording device according to claim 1 further comprising means for rewinding an end of the record paper in a direction toward the first record paper transport means from a pressure contacting portion of the first wrapping member with the platen roller, and that ink of the different colors are printed in an overlapping relationship at a same location of the record paper using the ink sheet having different colors successively on different portions of a face thereof.

12. A thermal transfer recording device for enabling recording with an ink sheet on a record paper in a form of a roll of paper comprising:

a thermal line head including head generating elements thereon;

a platen roller disposed in opposition to the thermal head so that the ink sheet is interposed between the platen roller and the thermal head and extends on opposite sides with respect to the platen roller;

first record paper transport means disposed upstream in a transporting direction of the record paper with respect to the platen roller for at least feeding the record paper from the roll of paper toward the platen roller;

wrapping means including at least a first wrapping member disposed on a first record paper transport means side with respect to the platen roller, the wrapping means being arranged for pressing the ink sheet toward the platen roller when the thermal head is in a non-printing position floating above the platen roller and in a non-pressure contacting condition with respect to the platen roller so that a leading edge of the record paper transported by the first record paper transport means is guided by the ink sheet and by the wrapping means along the platen roller with sufficient tension to enable feeding of the leading edge of the record paper without wrinkling of the record paper through a path therefor extending from the first record paper transport means; and means for moving the thermal head between the floating non-printing position thereof and a printing position in which the thermal head is pressed onto the platen roller with the ink sheet and the record paper interposed therebetween for enabling recording without producing a print disabled margin portion on the record paper.

13. A thermal transfer recording device according to claim 12, wherein the ink sheet and the wrapping means enable feeding of the leading edge of the record paper so that the record paper and the ink sheet are wrapped around the platen roller over a predetermined first acute angular range of the platen roller delimited from a line of contact between the thermal head and the platen roller toward the first record paper transport means.

14. A thermal transfer recording device comprising:

a thermal line head including heat generating elements thereon;

record paper in a form of a roll of paper;

a platen roller disposed in opposition to the thermal head;

an ink sheet interposed between the platen roller and the thermal head and extending on opposite sides with respect to the platen roller;

first record paper transport means including a roller having rigid body and a pinch roller positioned between the platen roller and the roll of paper for driving the record paper in a forward and reverse direction without slippage thereof;

thermal head positioning means for moving the thermal head among at least three positions with respect to the platen roller including a first position in which the thermal head is spaced and in a non-pressure contacting condition with respect to the platen roller, a second position wherein a fine air gap condition exists between the thermal head and the platen roller and a third position wherein a pressure contacting condition is obtained between the thermal head and the platen roller;

platen roller rotating means for rotating the platen roller including a clutch for enabling rotation of the platen roller with a circumferential speed greater than a speed with which the record paper is driven;

ink sheet wrapping means including two rollers for wrapping the platen roller with the ink sheet over a predetermined angular range, one of the two rollers of the ink sheet wrapping means on a first record paper transport means side being pressed toward the platen roller in the fine air gap condition; and ink sheet tensioning and braking means for enabling tensioning and braking by controlling at least one of a supply shaft for supplying the ink sheet and a take-up shaft for taking up the ink sheet.

15. A thermal transfer recording device according to claim 14, wherein the predetermined angular range is an acute angular range.

* * * * *